US012655575B2

(12) United States Patent
Jeon et al.

(10) Patent No.: US 12,655,575 B2
(45) Date of Patent: Jun. 16, 2026

(54) CLOTHES DRYER AND CONTROL METHOD THEREFOR

(71) Applicant: SAMSUNG ELECTRONICS CO., LTD., Suwon-si (KR)

(72) Inventors: Myungwon Jeon, Suwon-si (KR); Hocheol Lee, Suwon-si (KR); Minjoon Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 465 days.

(21) Appl. No.: 18/221,933

(22) Filed: Jul. 14, 2023

(65) Prior Publication Data

US 2023/0357982 A1 Nov. 9, 2023

Related U.S. Application Data

(63) Continuation of application No. PCT/KR2021/019677, filed on Dec. 23, 2021.

(30) Foreign Application Priority Data

Jan. 29, 2021 (KR) ..... 10-2021-0013077
Apr. 28, 2021 (KR) ..... 10-2021-0055272

(51) Int. Cl.
*D06F 58/50* (2020.01)
*D06F 58/22* (2006.01)
(Continued)

(52) U.S. Cl.
CPC ..... *D06F 58/50* (2020.02); *D06F 58/22* (2013.01); *D06F 58/38* (2020.02); *D06F 2103/42* (2020.02); *D06F 2105/58* (2020.02)

(58) Field of Classification Search
CPC ..... D06F 59/50; D06F 58/38; D06F 58/22; D06F 2103/42; D06F 2105/58
(Continued)

(56) References Cited

U.S. PATENT DOCUMENTS 5,709,040 A * 1/1998 Horwitz ..... D06F 58/22 34/604
5,852,881 A * 12/1998 Kuroda ..... D06F 58/50 34/562
(Continued)

FOREIGN PATENT DOCUMENTS

CN 110117891 A 8/2019
CN 120150438 A * 6/2025 ..... H02P 21/00
(Continued)

OTHER PUBLICATIONS

International Search Report dated Apr. 15, 2022 in International Patent Application No. PCT/KR2021/019677.
(Continued)

*Primary Examiner* — Stephen M Gravini
(74) *Attorney, Agent, or Firm* — STAAS & HALSEY LLP

(57) ABSTRACT

A clothes dryer comprising: a cabinet; a control panel including a power button and a display; a drum rotatable inside the cabinet; a filter to filter air discharged from the drum; a filter sensor to detect a mounting state of the filter and output a detection signal based on the mounting state of the filter detected; a memory to record a change in the mounted state of the filter as an event based on the mounting state of the filter detected by the filter sensor; and a processor to communicatively connect to the control panel, the filter sensor, the memory, and to control the display so that the display displays a notification related to the management of the filter based whether the event due to the change in the mounting state of the filter is recorded in the memory.

15 Claims, 10 Drawing Sheets

(51) Int. Cl.
*D06F 58/38* (2020.01)
*D06F 103/42* (2020.01)
*D06F 105/58* (2020.01)

(58) Field of Classification Search
USPC ..... 34/524, 595–610
See application file for complete search history.

(56) References Cited

U.S. PATENT DOCUMENTS

| | | | | |
|---|---|---|---|---|
| 5,899,005 | A * | 5/1999 | Chen | D06F 58/38 34/535 |
| 7,043,855 | B2 * | 5/2006 | Heilman | D06F 58/30 34/389 |
| 8,146,265 | B2 | 4/2012 | Oh et al. | |
| 9,163,351 | B2 | 10/2015 | Kim et al. | |
| 9,250,016 | B2 | 2/2016 | Kim et al. | |
| 9,542,819 | B2 | 1/2017 | Lee et al. | |
| 9,549,649 | B2 | 1/2017 | Baek et al. | |
| 11,486,081 | B2 * | 11/2022 | Pattarello | D06F 58/34 |
| 12,043,950 | B2 * | 7/2024 | Yoon | D06F 58/24 |
| 12,244,249 | B1 * | 3/2025 | Lin | H02P 25/062 |
| 12,252,837 | B2 * | 3/2025 | Reeves | D06F 58/38 |
| 12,467,180 | B2 * | 11/2025 | Borgerson | D06F 25/00 |
| 2013/0145648 | A1 | 6/2013 | Kim et al. | |
| 2022/0118129 | A1 * | 4/2022 | Ramirez | A61L 2/10 |
| 2023/0357982 | A1 * | 11/2023 | Jeon | D06F 34/14 |
| 2025/0034790 | A1 * | 1/2025 | Jung | D06F 58/22 |
| 2025/0034793 | A1 * | 1/2025 | Heo | D06F 58/22 |

FOREIGN PATENT DOCUMENTS

| | | | | |
|---|---|---|---|---|
| EP | 3919669 | A4 * | 12/2021 | |
| JP | 4642729 | | 3/2011 | |
| JP | 6149251 | | 6/2017 | |
| JP | 7060972 | | 4/2022 | |
| KR | 10-2004-0110807 | | 12/2004 | |
| KR | 10-2008-0013399 | | 2/2008 | |
| KR | 10-2008-0093829 | | 10/2008 | |
| KR | 10-2009-0071286 | | 7/2009 | |
| KR | 10-2013-0070310 | | 6/2013 | |
| KR | 10-2013-0082365 | | 7/2013 | |
| KR | 10-2013-0102939 | | 9/2013 | |
| KR | 10-2015-0074371 | | 7/2015 | |
| KR | 10-1603106 | | 3/2016 | |
| KR | 10-2019-0029817 | | 3/2019 | |
| KR | 10-2019-0128486 | | 11/2019 | |
| KR | 10-2021-0004601 | | 1/2021 | |
| KR | 20210148645 | A * | 12/2021 | D06F 58/04 |
| WO | WO 2008/118181 | A1 | 10/2008 | |
| WO | WO 2009/106926 | A1 | 9/2009 | |
| WO | WO-2022164039 | A1 * | 8/2022 | B01D 46/00 |

OTHER PUBLICATIONS

PCT/ISE/237 dated Apr. 15, 2022 in International Patent Application No. PCT/KR2021/019677.

Korean Office Action issued Feb. 12, 2026 for Application No. 10-2021-0055272.

* cited by examiner

CLOTHES DRYER AND CONTROL METHOD THEREFOR

CROSS-REFERENCE TO RELATED APPLICATION

This application is a continuation application, under 35 U.S.C. § 111(a), of international application No. PCT/KR2021/019677, filed on Dec. 23, 2021, which claims priority under 35 U.S.C. § 119 to Korean Patent Application No. 10-2021-0013077, filed Jan. 29, 2021 and Korean Patent Application No. 10-2021-0055272, filed Apr. 28, 2021, the disclosures of which are incorporated herein by reference in their entirety.

BACKGROUND

Field

The present disclosure relates to a clothes dryer including a filter and a filter sensor and a control method therefor.

Discussion of Related Art

A clothes dryer is a device that uses high-temperature dry air to dry objects to be dried. Generally, when laundry is dried using a clothes dryer, lint or dust is generated due to friction between objects to be dried. When lint accumulates in an air flow path, an air flow may not be smooth inside the clothes dryer, and an air volume for drying may be reduced. Also, a failure of the clothes dryer may occur in a case in which lint is stuck in components such as a motor and a fan.

In order to prevent the above, a clothes dryer includes a filter configured to filter lint. However, in a case in which lint accumulates in the filter, the lint may interfere with an air flow, and the lint may exit the filter and enter electronic components of the clothes dryer. Therefore, there is a need to provide a notification to clean the filter to a user.

SUMMARY

One disclosed embodiment provides a clothes dryer including: a cabinet; a control panel including a power button and a display; a drum rotatable inside the cabinet; a filter configured to filter air discharged from the drum; a filter sensor configured to detect a mounting state of the filter and output a detection signal based on a mounting state of the filter detected; a memory configured to record a change in the mounting state of the filter as an event based on the mounting state of the filter detected by the filter sensor; and a processor configured to communicatively connect to the control panel, the filter sensor and the memory, and control the display so that the display displays a notification relating to management of the filter based on whether the event due to the change in the mounting state of the filter is recorded in the memory.

One disclosed embodiment provides a control method for a clothes dryer including: receiving a detection signal from a filter sensor configured to detect a mounting state of a filter configured to filter air discharged from a drum; based on the detection signal, recording a change in the mounting state of the filter as an event in a memory; and based on the event recorded in the memory, controlling a display so that the display displays a notification relating to management of the filter based on whether the event due to the change in the mounting state of the filter is recorded in the memory.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
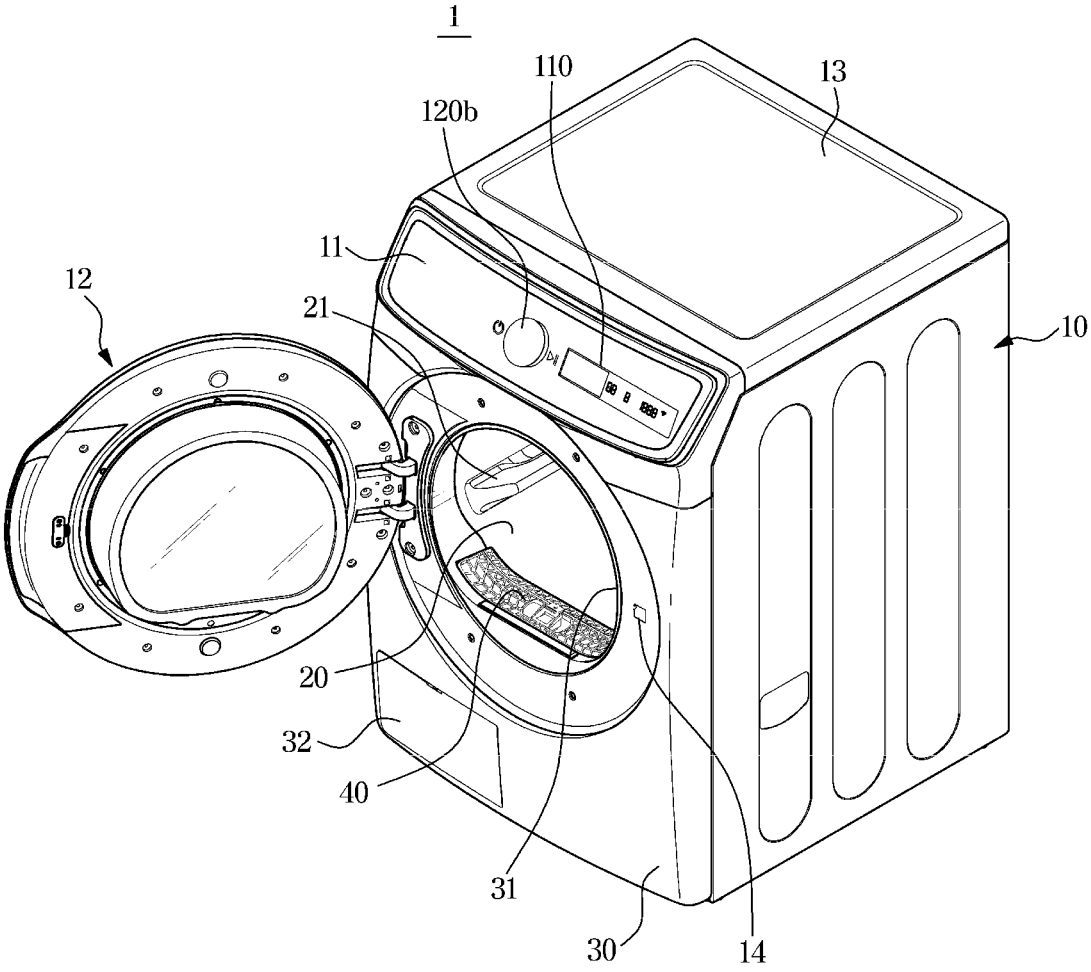
FIG. 1 illustrates a clothes dryer according to one embodiment.

Like reference numerals refer to like elements throughout the specification. Not all elements of embodiments are described herein, and description of content widely known in the art to which the present disclosure pertains or content overlapping between the embodiments will be omitted. The terms "portion," "module," "member," and "block" used herein may be implemented using software or hardware, and according to embodiments, a plurality of "portions," "modules," "members," or "blocks" may be implemented as a single element, or a single "portion," "module," "member," or "block" may include a plurality of elements.

Throughout the specification, when a certain portion is described as being "connected" to another portion, this includes a case in which the certain portion is indirectly connected to the other portion as well as a case in which the certain portion is directly connected to the other portion, and the indirect connection includes connection through a wireless network or electrically connecting through electrical wiring.

Also, terms used herein are for describing the embodiments and are not used to limit or restrict the disclosure. A singular expression includes a plural expression unless context clearly indicates otherwise. In the application, terms such as "include" or "have" are used to describe that features, numbers, steps, operations, elements, components, or combinations thereof are present and thus do not preclude the possibility of other features or elements being further included.

Also, terms including ordinals such as "first" and "second" used herein are used to distinguish between a plurality of elements, and the used ordinals do not indicate an order of arrangement, a manufacturing order, an importance, or the like between the elements. The term "and/or" includes a combination of a plurality of associated listed items or any one item among the plurality of associated listed items.

Meanwhile, terms such as "front," "rear," "left," "right," "upper," and "lower" are defined based on the drawings, and the shape and position of each element are not limited by the terms.

Hereinafter, embodiments of the present disclosure will be described in detail.

The present disclosure provides a clothes dryer and a control method therefor capable of accurately informing a user of whether a filter needs cleaning.

A clothes dryer and a control method therefor disclosed herein can recall whether a filter has been cleaned and accurately inform a user of whether the filter needs cleaning.

A clothes dryer and a control method therefor disclosed herein can guide correct management of a filter by providing a notification in a case in which the filter needs cleaning. Therefore, it is possible to prevent a problem that may occur due to not cleaning the filter.

FIG. 1 illustrates a clothes dryer according to one embodiment.

Referring to FIG. 1, a clothes dryer 1 may include a cabinet 10 configured to form an exterior and a drum 20 rotatably installed in the cabinet 10. The cabinet 10 may be provided in a substantially parallelepiped shape.

The cabinet 10 may include a front cover 30 configured to form a front surface, an upper cover 13 configured to form an upper surface, and a base (not illustrated) configured to form a bottom surface. A heat exchanger cover 32 configured to allow a user to approach a heat exchanger may be detachably mounted on the front cover 30 of the cabinet 10.

As an example, each of the front cover 30, the upper cover 13, and the base which form the cabinet 10 may be separately provided and assembled. As another example, some of the elements forming the cabinet 10 (for example, the front cover, the upper cover, and the base) may be integrally formed.

An inlet 31 configured to allow clothes (not illustrated), which are objects to be dried, to be inserted into or withdrawn from the drum 20 is provided in the front surface of the cabinet 10. The clothes dryer 1 may include a door 12 provided to open and close the inlet 31 formed in the front cover 30. The user may open the door 12 and then insert or discharge the objects to be dried into or from the drum 20 through the inlet 31. As the inlet 31 is closed and the clothes dryer 1 begins operating, a door lock 14 may lock the door 12.

A control panel 11 for an interaction between the user and the clothes dryer 1 may be provided at an upper side of the front surface of the cabinet 10. The control panel 11 may obtain a user input and display various pieces of information on the clothes dryer 1.

The control panel 11 may include a display 110 configured to illustrate various pieces of information on the clothes dryer 1. Also, the control panel 11 may include an input device 120 configured to obtain a user input that relates to the operation of the clothes dryer 1. The input device 120 may include a rotatable dial and various buttons. The control panel 11 may include various other forms of input devices and displays.

The clothes dryer 1 may include a filter 40 detachably mounted on the front cover 30. The filter 40 may filter foreign matter such as lint that flows along with air circulating inside the drum 20.

Figure 2:
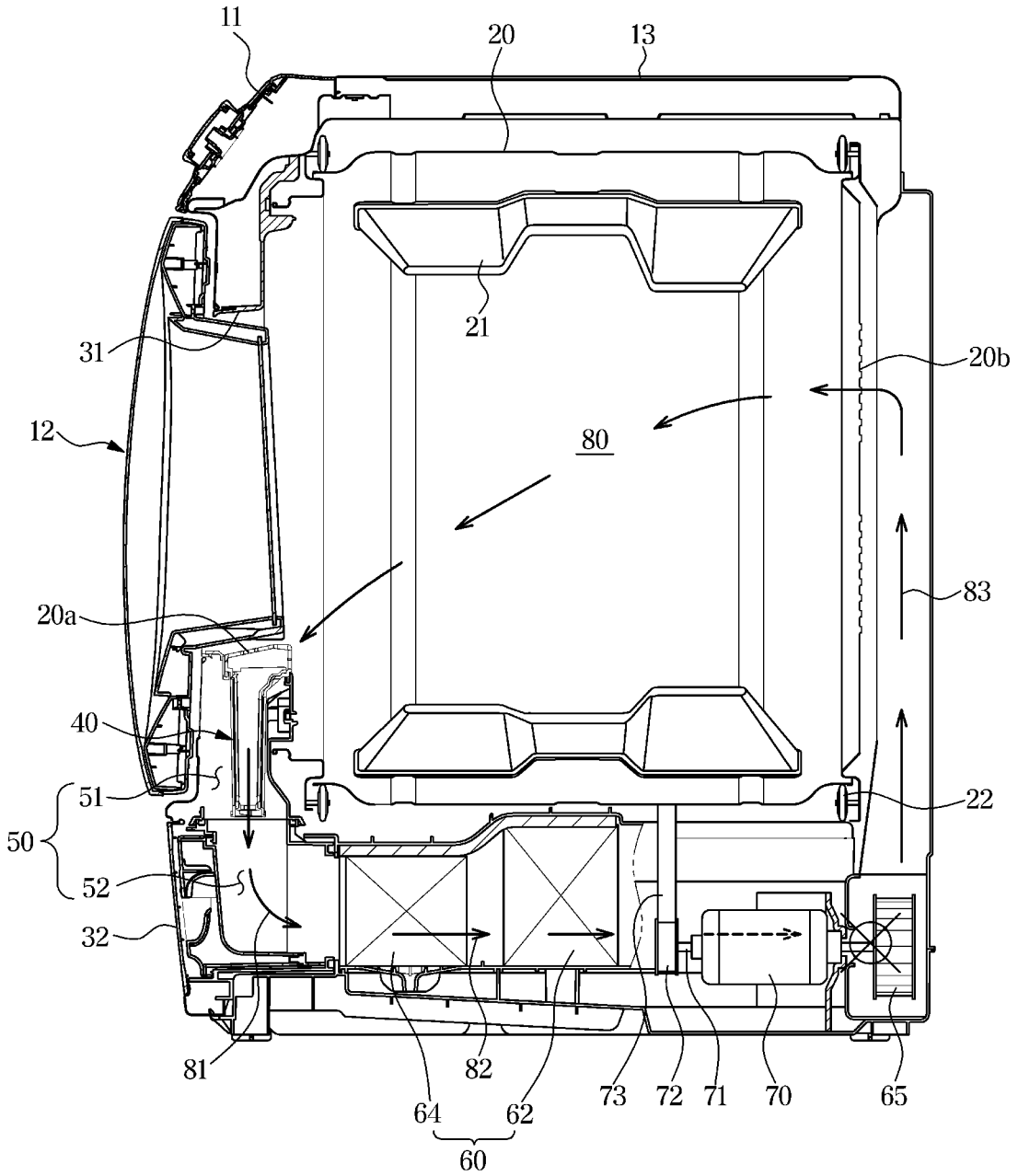
FIG. 2 is a cross-sectional view of the clothes dryer according to one embodiment.

FIG. 2 is a cross-sectional view of the clothes dryer according to one embodiment.

Referring to FIG. 2, the drum 20 having a cylindrical shape may be provided inside the cabinet 10. The drum 20 is provided to accommodate objects to be dried therein and dry the objects to be dried. The drum 20 may be provided to receive power from a driving device and be rotatable. The drum 20 may be provided inside the cabinet 10 and may be rotatable about a rotating axis provided to be substantially horizontal to the ground.

A lifter 21 may be provided on an inner peripheral surface of the drum 20 to lift objects to be dried when the drum 20 rotates. As the drum 20 rotates, the objects to be dried may repeatedly move upward due to the lifter 21 and then fall. A roller 22 configured to support the drum 20 so that the drum 20 smoothly rotates may be provided on an outer peripheral surface of the drum.

The driving device may be disposed at a lower portion of the inside of the cabinet 10. The driving device may be mounted on the base. The driving device may include a motor 70, a pulley 72 configured to transmit power of the motor 70 to the drum 20, and a belt 73.

The pulley 72 may be connected to a rotating shaft 71 connected to the motor 70. When the rotating shaft 71 rotates due to the motor 70, the pulley 72 may rotate along with the rotating shaft 71. The belt 73 may be installed to be wound around an outer surface of the pulley 72 and an outer surface of the drum 20. When the belt 73 rotates due to a driving force of the motor 70, the drum 20 may rotate along with the belt 73.

A flow path 80 configured to circulate air may be formed inside the cabinet 10 and inside the drum 20. The flow path 80 may include an air discharge flow path 81 configured to discharge air from the inside of the drum 20 to the outside of the drum 20, a connecting flow path 82 configured to dry air discharged from the drum 20, and an air supply flow path 83 configured to supply the dried air to the inside of the drum 20.

The clothes dryer 1 may include a discharge duct 50 configured to form the air discharge flow path 81 and the connecting flow path 82. The discharge duct 50 may include a filter duct 51 connected to an air outlet **20*a* and in which the filter 40 is disposed and a guide duct 52 configured to guide air from the filter duct 51 to a heat pump 60**.

Also, a fan 65 configured to cause air to flow may be provided at a lower rear portion of the cabinet 10. The fan 65 may suction air discharged through the air outlet **20*a* of the drum 20 and may move air to an air inlet 20*b* of the drum 20 through the air supply flow path 83. Due to the operation of the fan 65, the air inside the drum 20 circulates. The air supplied into the drum 20 through the air inlet 20*b* of the drum 20 may be used in drying the objects to be dried and may be discharged to the filter duct 51 through the air outlet 20*a***.

The motor 70 may rotate the fan 65 as well as the drum 20. Although the case in which the drum 20 and the fan 65 are driven by a single motor 70 has been described, a fan motor (not illustrated) configured to drive the fan 65 may be separately provided.

The filter 40 may be mounted in the filter duct 51. Air discharged through the air outlet **20*a* may be filtered while passing through the filter 40. That is, the filter 40** may filter foreign matter such as lint from the air.

The heat pump 60 may be disposed in the guide duct 52. The heat pump 60 may include a compressor 61, a condenser 62, an expander 63, and an evaporator 64. Although the compressor 61 and the expander 63 are not illustrated in FIG. 2, the compressor 61 and the expander 63 may be seated on a bottom surface inside the cabinet 10 together with the condenser 62 and the evaporator 64.

Air discharged from the drum 20 may be dried at a high temperature while flowing along the connecting flow path 82 formed by the guide duct 52. The air dried at a high temperature may be supplied into the drum 20 again via the air supply flow path 83. The objects to be dried placed in the drum 20 may be dried by the air dried at a high temperature. A specific operation of the heat pump 60 will be described below with reference to FIG. 4.

Figure 3:
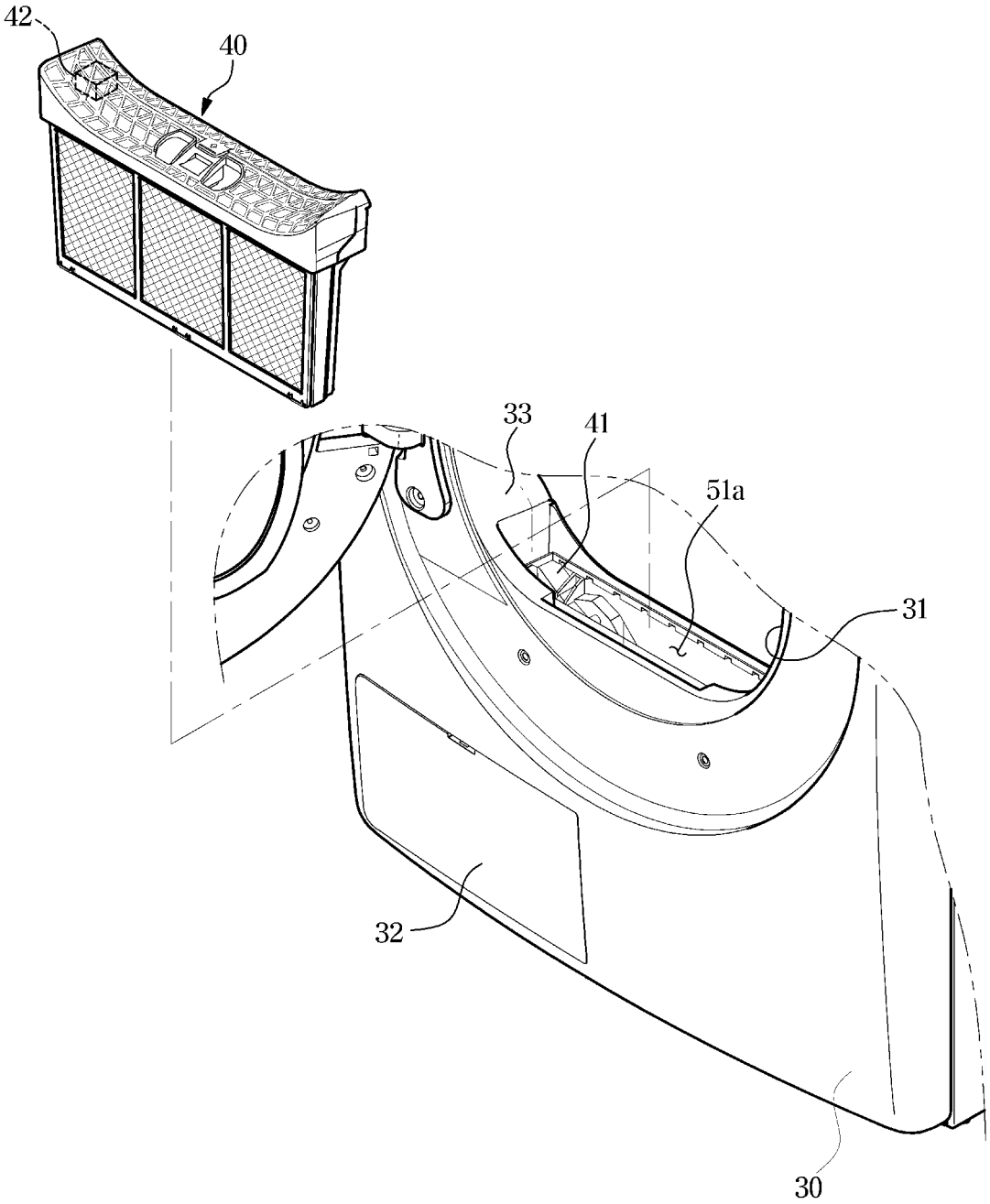
FIG. 3 illustrates a state in which a filter is separated from the clothes dryer according to one embodiment.

FIG. 3 illustrates a state in which the filter is separated from the clothes dryer according to one embodiment.

Referring to FIG. 3, the filter 40 may be detachably mounted in the filter duct 51. The filter duct 51 may be provided in the front cover 30 of the cabinet 10. The front cover 30 may include a rim 33 configured to form the inlet 31, and the filter duct 51 may be formed at a lower side of the center of the rim 33. The rim 33 may connect the outside of the cabinet 10 and the inside of the drum 20 and may be provided in an annular shape.

The filter duct 51 may include a filter mounting groove 51*a* into which the filter 40 is inserted. Lint generated during the process of drying the objects to be dried may be stored in the filter 40. The user may, after the drying cycle is completed or before the drying cycle begins, separate the filter 40 from the filter mounting groove 51*a* and remove the lint. The user may insert the cleaned filter 40 into the filter mounting groove 51*a* again and then operate the clothes dryer 1.

A filter sensor 41 configured to detect a mounting state of the filter 40 may be provided in the filter duct 51. The filter sensor 41 may be provided at one side of the filter mounting groove 51*a*. The filter sensor 41 may include a magnet sensor configured to detect a magnetic force generated when the filter 40 is mounted.

Also, the filter 40 may include a magnet 42. The filter sensor 41 may output a detection signal of the filter 40 due to the magnet 42 disposed in the filter 40 or may not output the detection signal. The magnet 42 may be provided at one side of the filter 40 to correspond to the position of the filter sensor 41. For example, the filter sensor 41 may be disposed to face the magnet 42 of the filter 40 when the filter 40 is mounted in the filter mounting groove 51*a*. When the filter 40 is inserted into the filter mounting groove 51*a*, the magnet 42 may come in contact with the filter sensor 41, and the filter sensor 41 may detect a magnetic force of the magnet 42. The filter sensor 41 may send the detection signal to a processor 220 in response to detecting the magnetic force of the magnet 42.

Also, the filter sensor 41 may be implemented as an electrode sensor configured to detect an electric force generated when the filter 40 is mounted. In the case in which the filter sensor 41 is implemented as an electrode sensor, an electrode, instead of the magnet 42, may be provided in the filter 40. When the filter 40 is mounted in the filter duct 51, current may be carried between the electrode of the filter 40 and the filter sensor 41. The filter sensor 41 may send a detection signal to the processor 220 in response to detecting the electric force due to mounting of the filter 40.

As another example, the filter 40 may include the filter sensor 41, and a magnet or an electrode may be provided in the filter duct 51. As still another example, the filter sensor 41 may be implemented as a switch. The switch may be turned on when the filter 40 is mounted and may be turned off when the filter 40 is detached.

Regardless of the type of sensor, any other sensor may be adopted as the filter sensor 41 as long as the sensor can detect mounting of the filter 40.

Figure 4:
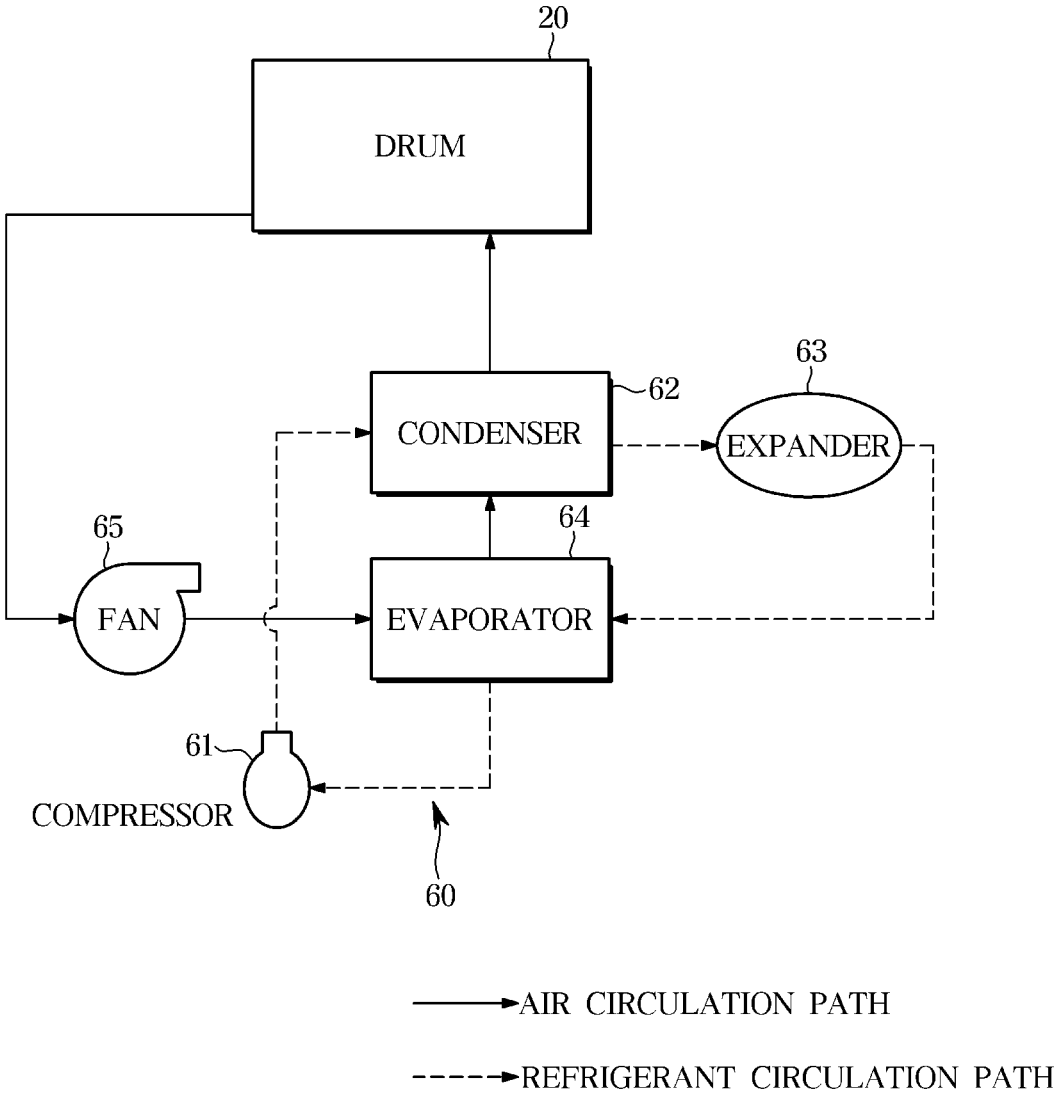
FIG. 4 illustrates a flow of air and a flow of a refrigerant in the clothes dryer according to one embodiment.

FIG. 4 illustrates a flow of air and a flow of a refrigerant in the clothes dryer according to one embodiment.

Referring to FIG. 4, the heat pump 60 may include the compressor 61, the condenser 62, the expander 63, and the evaporator 64. The compressor 61, the condenser 62, the expander 63, and the evaporator 64 may be connected to each other by a refrigerant pipe and constitute a heat pump cycle, and a refrigerant may circulate along the heat pump cycle while flowing in the refrigerant pipe. When the drying cycle begins, the compressor 61 may operate, and the refrigerant may circulate along the refrigerant pipe.

The compressor 61 may compress a low-temperature, low-pressure gaseous refrigerant and discharge a high-temperature, high-pressure gaseous refrigerant. For example, the compressor 61 may compress the refrigerant using the reciprocating motion of a piston or the rotary motion of a rotor. The discharged gaseous refrigerant may be delivered to the condenser 62.

The condenser 62 may condense the high-temperature, high-pressure gaseous refrigerant into a high-pressure liquid or close-to-liquid refrigerant having a temperature lower than or equal to a condensing temperature. The condenser 62 may dissipate heat to the surroundings through the process of condensing the refrigerant. The condenser 62 may heat air through the heat generated in the process of condensing the refrigerant. The liquid refrigerant obtained by condensation in the condenser 62 may be delivered to the expander 63.

The high-temperature, high-pressure liquid refrigerant obtained by condensation in the condenser 62 is expanded and decompressed in the expander 63. For example, the expander 63 may include a capillary tube configured to control pressure of the liquid refrigerant and an electronic expansion valve whose opening amount may be changed according to an electrical signal. A low-temperature, low-pressure two-phase refrigerant that has passed through the expander 63 is introduced into the evaporator 64.

The evaporator 64 may evaporate the two-phase refrigerant introduced from the expander 63. As a result, the evaporator 64 may return the low-temperature, low-pressure refrigerant to the compressor 61. The evaporator 64 may absorb heat from the surroundings through the evaporation process in which the low-pressure two-phase refrigerant is converted into a gaseous refrigerant. The evaporator 64 may cool air passing through the evaporator 64 in the evaporation process.

As surrounding air is cooled by the evaporator 64, and the temperature of the surrounding air becomes lower than the dew point, the air around the evaporator 64 may be condensed. Water obtained by condensation in the evaporator 64 may fall due to gravity and be accommodated in a water tray (not illustrated) provided under the evaporator 64. Here, a portion of the water obtained by condensation in the evaporator 64 may stay in the evaporator 64 due to surface tension.

Due to condensation occurring around the evaporator 64, the absolute humidity of air passing through the evaporator 64 may be reduced. In other words, the amount of water vapor contained in the air passing through the evaporator 64 may be reduced. Using the condensation around the evaporator 64, the clothes dryer 1 may reduce the amount of water vapor contained in air inside the drum 20.

The evaporator 64 may be positioned upstream of the condenser 62 based on a flow of air caused by the fan 65. Air suctioned from the drum 20 is dried (water vapor is condensed) by the evaporator 64 while passing through the evaporator 64.

The air that has passed through the evaporator 64 moves toward the condenser 62. As described above, the condenser 62 may dissipate heat while the refrigerant is being condensed. As a result, the air that has passed through the evaporator 64 may be heated by the condenser 62 while passing through the condenser 62.

The air heated by the condenser 62 may be introduced into the drum 20 through the air inlet 20*b* of the drum 20 and may absorb moisture from the objects to be dried placed in the drum 20. The air that has absorbed moisture may move to the evaporator 64 again. In this way, the air may dry the objects to be dried while circulating the inside of the drum 20.

The clothes dryer 1 has been described as including the heat pump 60, but the present disclosure is not limited thereto. The clothes dryer 1 may include an electric heater (not illustrated).

Figure 5:
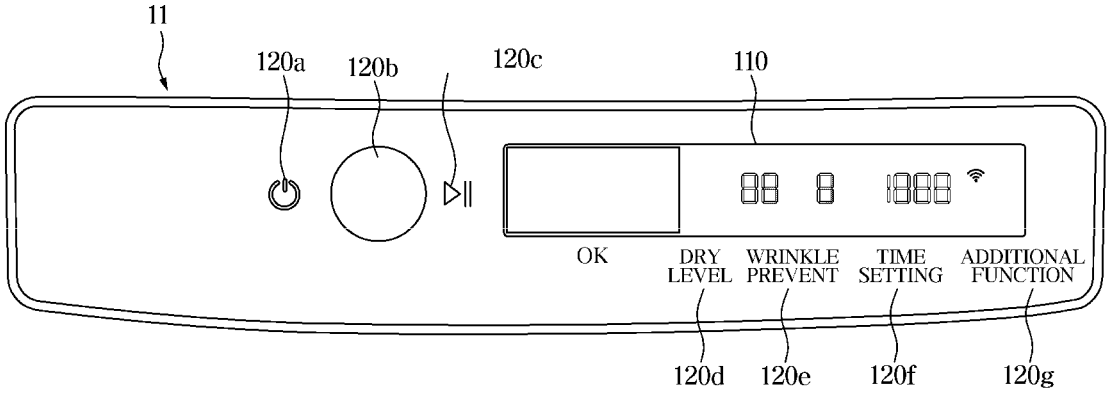
FIG. 5 illustrates a control panel included in the clothes dryer according to one embodiment.

FIG. 5 illustrates the control panel included in the clothes dryer according to one embodiment.

Referring to FIG. 5, the control panel 11 may include the input device 120 configured to obtain a user input and the display 110 configured to display drying settings and/or operational information of the clothes dryer 1 in response to the user input.

The display 110 of the control panel 11 may display operational information of the clothes dryer 1. For example, the display 110 may display the time remaining until the end of the drying operation of the clothes dryer 1. The display 110 may include a liquid crystal display (LCD) panel and/or a light emitting diode (LED) panel.

The input device 120 of the control panel 11 may include various buttons 120*a*, 120*c*, 120*d*, 120*e*, 120*f*, and 120*g* and a rotatable dial 120*b*. For example, the input device 120 may include a power button 120*a* configured to turn on or off the power of the clothes dryer 1, an operation button 120*c* configured to start or pause the drying operation, and a plurality of setting buttons 120*d*, 120*e*, 120*f*, and 120*g* configured to select drying settings of the clothes dryer 1. When a user input to turn on the power of the clothes dryer 1 is received through the power button 120*a*, the control panel 11 may send a control signal for reading information recorded in a memory 210 to the processor 220.

A first setting button 120*d* may obtain a user input to select "Dry Level," a second setting button 120*e* may obtain a user input to select an operation for "Wrinkle Prevent," a third setting button 120*f* may obtain a user input to select "Drying Time," and a fourth setting button 120*g* may obtain a user input to select "Additional Function." Setting information selected through the setting buttons 120*d*, 120*e*, 120*f*, and 120*g* may be displayed on the display 110.

The buttons 120*a*, 120*c*, 120*d*, 120*e*, 120*f*, and 120*g* of the input device 120 may include a tact switch, a push switch, a slide switch, a toggle switch, a microswitch, or a touch switch. Also, the buttons 120*a*, 120*c*, 120*d*, 120*e*, 120*f*, and 120*g* may include an LED.

Also, the dial 120*b* of the input device 120 may obtain a user input (turning and stopping the dial) to select one of a plurality of drying courses. The display 110 may, depending on the turning of the dial 120*b*, display the plurality of drying courses in a predetermined order. A drying course displayed on the display 110 at the time the turning of the dial 120*b* is stopped may be selected.

A drying course may include predetermined drying settings (for example, a dry level, an additional time to prevent wrinkles, a drying time) according to the type of object to be dried (for example, shirts, duvets, underwear) and material thereof (for example, cotton, wool). For example, standard drying may include drying settings that can be applied to most objects to be dried, and duvet drying may include drying settings optimized for drying a duvet.

Figure 6:
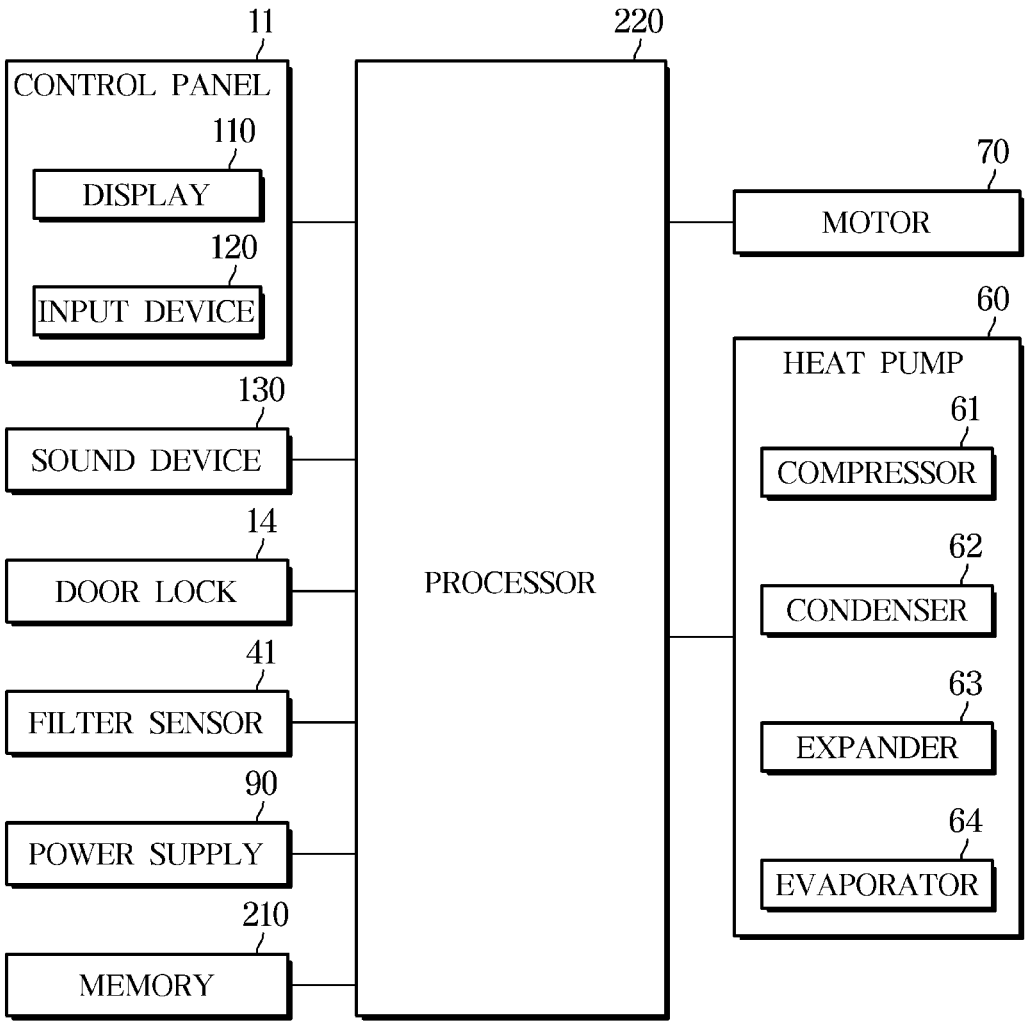
FIG. 6 is a control block diagram of the clothes dryer according to one embodiment.

FIG. 6 is a control block diagram of the clothes dryer according to one embodiment.

Referring to FIG. 6, the clothes dryer 1 may include the control panel 11, the door lock 14, the filter sensor 41, the heat pump 60, the motor 70, a power supply 90, the memory 210, and the processor 220. Also, the clothes dryer 1 may include a sound device 130 configured to output sound.

The processor 220 may be electrically connected to the door lock 14, the filter sensor 41, the heat pump 60, the motor 70, the power supply 90, the display 110, the input device 120, the sound device 130, and the memory 210. The processor 220 may control the elements of the clothes dryer 1 that are electrically connected to the processor 220. The memory 210 may recall or store instructions, programs, and data for controlling the operation of the clothes dryer 1.

The control panel 11 may include the display 110 and the input device 120 as described above. The door lock 14 may lock the door 12 in response to a locking signal of the processor 220.

The motor 70 may rotate the drum 20 and the fan 65 in response to a driving signal of the processor 220. The heat pump 60 includes the compressor 61, the condenser 62, the expander 63, and the evaporator 64 as described above. The compressor 61 may circulate the refrigerant of the heat pump 60 in response to the driving signal of the processor 20.

The power supply 90 may supply power to the elements of the clothes dryer 1. The power supply 90 may be implemented using a printed circuit board and a power supply circuit mounted on the printed circuit board. For example, the power supply 90 may include a condenser, a coil, a resistive element, a processor, and the like and a power supply circuit board on which the condenser, coil, resistive element, processor, and the like are mounted.

The filter sensor 41 may detect a mounting state of the filter 40. The filter sensor 41 may output a detection signal to the processor 220 in a case in which the filter 40 is mounted. The filter sensor 41 may stop outputting the detection signal in a case in which the filter 40 is detached. When the detection signal is sent from the filter sensor 41, the processor 220 may determine that the filter 40 is mounted. When sending of the detection signal from the filter sensor 41 is stopped, the processor 220 may determine that the filter 40 is detached.

The memory 210 may record a change in the mounting state of the filter 40 as an event. For example, based on the output of the detection signal from the filter sensor 41 being stopped and then resumed, the processor 220 may record an event in the memory 210. The event recorded in the memory 210 may correspond to a state in which the filter 40 is removed and then mounted. The event recorded in the memory 210 may include an event recorded in a state in which the power of the clothes dryer 1 is turned off.

In response to a control signal received through the power button 120*a* of the control panel 11, the processor 220 may read whether an event is recorded in the memory 210. Based on whether an event is recorded in the memory 210, the processor 220 may determine whether to display, or not display, a notification relating to management of the filter 40. The notification relating to management of the filter 40 may be a message informing that the filter 40 needs cleaning.

Based on an event recorded in the memory 210, the processor 220 may control the display 110 to not display the notification relating to management of the filter 40. Also, based on the absence of an event recorded in the memory 210, the processor 220 may control the display 110 to display the notification relating to management of the filter 40. In a case in which an occurrence of an event in which the mounting state of the filter 40 is changed is not recorded in the memory 210, cleaning of the filter 40 may be determined as necessary. The notification relating to management of the filter 40 may be provided before the start of the drying cycle. Also, based on the absence of an event recorded in the memory 210, the processor 220 may control the sound device 130 to output a notification sound corresponding to the notification relating to management of the filter 40.

Based on a confirmation signal or a signal indicating remounting of the filter 40 that is received through the control panel 11 after the notification relating to management of the filter 40 is displayed, the processor 220 may control the display 110 to output a message requesting for selection of a drying course. As another example, when a predetermined amount of time passes after the notification relating to management of the filter 40 is displayed, the processor 220 may control the display 110 to output a message requesting for selection of a drying course. The processor 220 may perform the drying cycle based on an input of the selection of the drying course. Also, based on the presence of an event recorded in the memory 210, the processor 220 may control the display 110 to output a message requesting for selection of a drying course. In a case in which an event is recorded in the memory 210, cleaning of the filter 40 may be determined as unnecessary. Accordingly, selection of a drying course may be guided without the notification relating to management of the filter 40 being provided. That is, the processor 220 may proceed to a drying course selection process even without a user's confirmation on cleaning of the filter 40 or remounting of the filter 40.

The processor 220 may reset the memory 210 in response to a drying course selection signal or reset the memory 210 in response to completion of the drying cycle. Resetting the memory 210 may indicate deleting an event recorded therein. That is, resetting the memory 210 may indicate initializing a partial space of the memory 210 allocated to store an event relating to a change in the mounting state of the filter 40 to "null." The processor 220 may reset the memory 210 in order to record anew event after the current drying cycle is completed. Also, the processor 220 may delete an event recorded in the memory 210 upon completion of the operation of the clothes dryer 1.

Meanwhile, the processor 220 may identify the mounting state of the filter 40 based on a detection signal from the filter sensor 41 after the drying cycle is completed. That is, when sending of the detection signal from the filter sensor 41 is stopped and then resumed after the drying cycle is completed, an event in which the mounting state of the filter 40 is changed may be recorded in the memory 210. Based on the change in the mounting state of the filter 40, the processor 220 may determine that cleaning of the filter 40 is completed. Also, the processor 220 may control the display 110 to display the notification relating to management of the filter 40 in order to guide cleaning of the filter 40 after the drying cycle is completed.

Cleaning of the filter 40 may be performed after the power of the clothes dryer 1 is turned off in some cases. In the case in which the clothes dryer 1 is connected to an external power supply at all times, the clothes dryer 1 may consume standby power even in a state in which the power of the clothes dryer 1 is turned off. Accordingly, even in the state in which the power of the clothes dryer 1 is turned off, the filter sensor 41 and the processor 220 may operate using standby power. That is, the processor 220 may record an event relating to the mounting state of the filter 40 detected by the filter sensor 41 in the memory 210 using standby power in the state in which the power of the clothes dryer 1 is turned off. The event recorded in the memory 210 may correspond to a state in which the filter 40 is removed and then mounted. The event recorded in the memory 210 may include an event recorded in the state in which the power of the clothes dryer 1 is turned off.

In the related art, a notification relating to cleaning of the filter 40 is unconditionally provided upon the power of the clothes dryer 1 being turned on, regardless of whether the filter 40 has been cleaned after completion of the previous drying cycle. Accordingly, the user may receive an unnecessary notification despite having cleaned the filter 40, and the notification relating to cleaning of the filter 40 may be ignored in many cases.

The clothes dryer 1 disclosed herein provides the notification relating to management of the filter 40 based on whether the filter 40 has been cleaned and thus can more accurately inform the user of whether the filter 40 needs cleaning.

Examples of the memory 210 may include a volatile memory (for example, a static random-access memory (S-RAM), a dynamic random-access memory (D-RAM)) and a nonvolatile memory (for example, a read-only memory (ROM), an erasable programmable read-only memory (EPROM)). The processor 220 and the memory 210 may be implemented using separate chips or implemented using a single chip. Also, a plurality of processors and a plurality of memories may be provided. The processor 220 may process data and/or signals using a program provided from the memory 210 and provide a control signal to each element of the clothes dryer 1. The processor 220 may include an arithmetic circuit, a memory circuit, and a control circuit. Also, the processor 220 may include a single core or include a plurality of cores.

Figure 7:
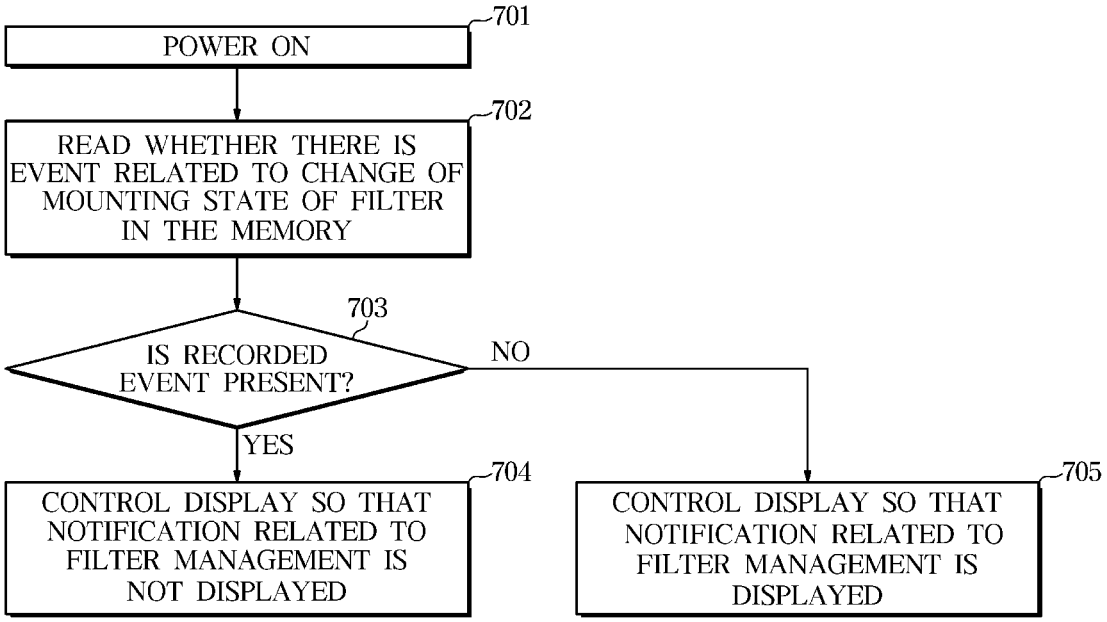
FIG. 7 is a flowchart for describing a control method for the clothes dryer according to one embodiment.

FIG. 7 is a flowchart for describing a control method for the clothes dryer according to one embodiment. Referring to FIG. 7, first, the power of the clothes dryer 1 may be turned on (701). The power of the clothes dryer 1 may be turned on or off by the power button 120*a*. The processor 220 may, based on a control signal received through the power button 120*a*, read whether an event relating to the mounting state of the filter 40 is present in the memory 210 (702). When a user input to turn on the power of the clothes dryer 1 is received through the power button 120*a*, the control panel 11 may send a control signal for reading information recorded in the memory 210 to the processor 220.

Based on an event recorded in the memory 210, the processor 220 may control the display 110 to not display the notification relating to management of the filter 40 (703, 704). Based on the absence of an event recorded in the memory 210, the processor 220 may control the display 110 to display the notification relating to management of the filter 40 (703, 705).

In this way, the clothes dryer 1 disclosed herein may, based on whether an event relating to a change in the mounting state of the filter 40 is recorded in the memory 210, determine whether to provide the notification relating to management of the filter 40. Accordingly, the user can be more accurately informed of whether the filter 40 needs cleaning.

Figure 8:
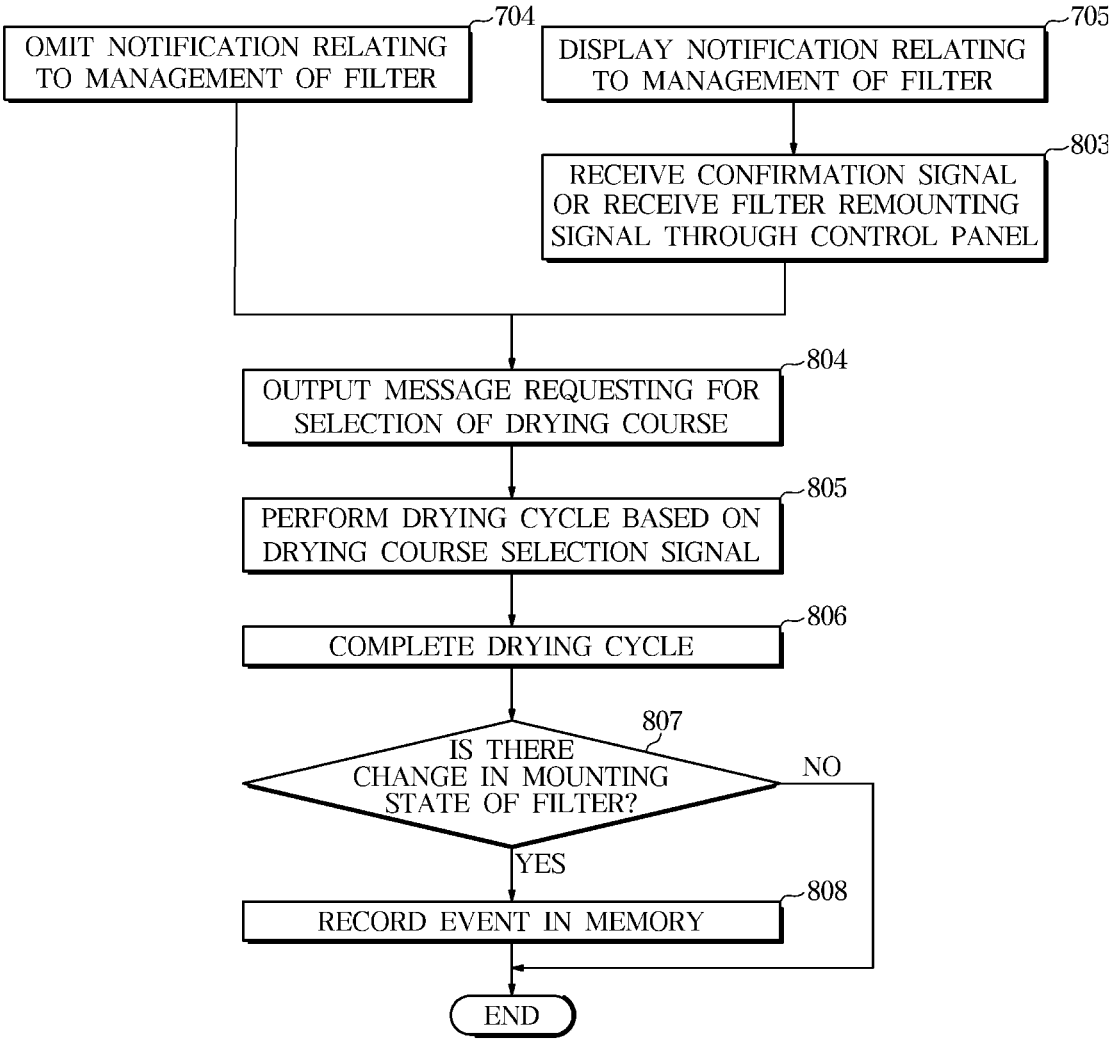
FIG. 8 is a flowchart for describing the control method for the clothes dryer continuing from FIG. 7.
Figure 9:
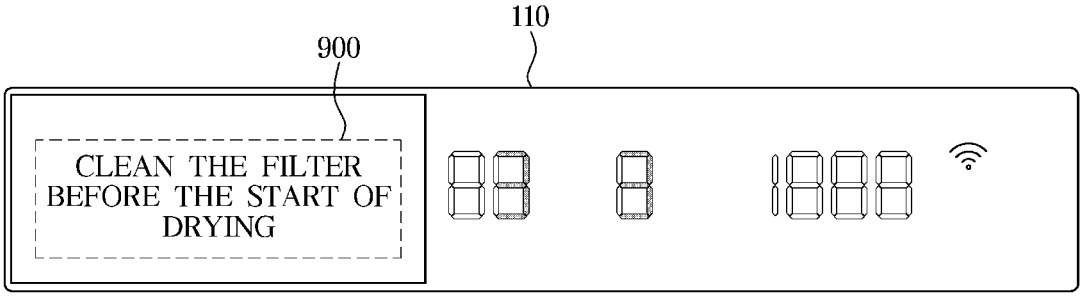
FIG. 9 illustrates one example of a message output on a display included in the clothes dryer according to one embodiment.
Figure 10:
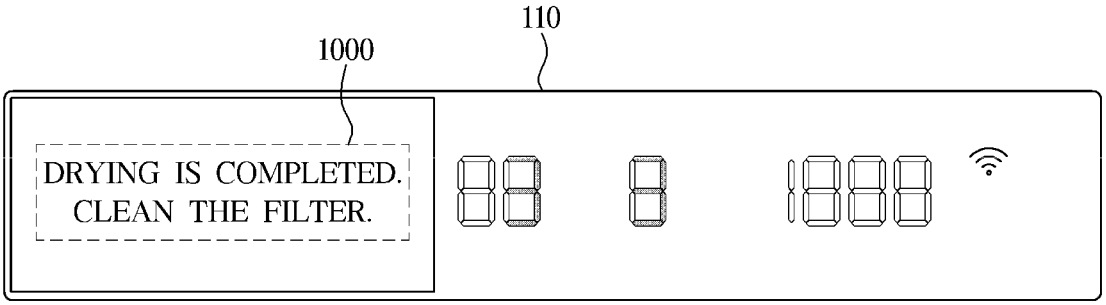
FIG. 10 illustrates another example of a message output on the display included in the clothes dryer according to one embodiment.

FIG. 8 is a flowchart for describing the control method for the clothes dryer continuing from FIG. 7. FIG. 9 illustrates one example of a message output on the display included in the clothes dryer according to one embodiment. FIG. 10 illustrates another example of a message output on the display included in the clothes dryer according to one embodiment.

Referring to FIG. 8, as described above with reference to FIG. 7, the processor 220 may control the display 110 to display the notification relating to management of the filter 40, based on the absence of an event recorded in the memory 210 (705). For example, as illustrated in FIG. 9, the display 110 may output a message 900 "Clean the filter before the start of drying." Also, the display 110 may output a graphic object such as an icon for informing that the filter 40 needs cleaning. In addition, the processor 220 may control the sound device 130 to output a notification sound corresponding to the notification to clean the filter 40.

After the notification relating to management of the filter 40 is displayed, the processor 220 may receive a confirmation signal or a signal indicating remounting of the filter 40 through the control panel 11 (803). The confirmation signal may be input using one of the buttons 120*a*, 120*c*, 120*d*, 120*e*, 120*f*, and 120*g* and the dial 120*b* included in the input device 120 of the control panel 11. The signal indicating remounting of the filter 40 may be received from the filter sensor 41.

Based on the confirmation signal or the signal indicating remounting of the filter 40 that is received through the control panel 11, the processor 220 may control the display 110 to output a message requesting for selection of a drying course (804). As another example, when a predetermined amount of time passes after the notification relating to management of the filter 40 is displayed, the processor 220 may control the display 110 to output a message requesting for selection of a drying course.

In a case in which the notification relating to management of the filter 40 is omitted due to an event recorded in the memory 210 (704), the processor 220 may control the display 110 to output a message requesting for selection of a drying course (804). That is, cleaning of the filter 40 may be determined as unnecessary due to the event recorded in the memory 210, and the notification relating to management of the filter 40 may be omitted. Accordingly, the processor 220 may proceed to a drying course selection process even without a user's confirmation on cleaning of the filter 40 or remounting of the filter 40.

The processor 220 may perform the drying cycle based on a drying course selection signal (805). Selection of a drying course may be input through the control panel 11. The drying cycle may be performed based on the selected drying course, and the drying cycle may be completed after an elapse of a drying time set according to the drying course (806).

The processor 220 may identify the mounting state of the filter 40 based on a detection signal from the filter sensor 41. The processor 220 may identify a change in the mounting state of the filter 40 based on a change in the detection signal from the filter sensor 41 (807). The processor 220 may record an event in which the mounting state of the filter 40 is changed in the memory 210 (808). When the detection signal is sent from the filter sensor 41, the processor 220 may determine that the filter 40 is mounted. When sending of the detection signal from the filter sensor 41 is stopped, the processor 220 may determine that the filter 40 is detached. Based on the output of the detection signal from the filter sensor 41 being stopped and then resumed, the processor 220 may record an event in the memory 210. The event recorded in the memory 210 may correspond to a state in which the filter 40 is removed and then mounted. The event recorded in the memory 210 may include an event recorded in a state in which the power of the clothes dryer 1 is turned off.

Meanwhile, the processor 220 may reset the memory 210 in response to a drying course selection signal or reset the memory 210 in response to completion of the drying cycle. Resetting the memory 210 may also be performed after a notification is output through the display 110 or a notification to clean the filter 40 is determined to be omitted. Resetting the memory 210 may indicate deleting an event recorded therein. The processor 220 may reset the memory 210 in order to record a new event in the memory 210. Also, the processor 220 may delete an event recorded in the memory 210 upon completion of the operation of the clothes dryer 1.

Referring to FIG. 10, the notification relating to management of the filter 40 may be provided after the drying cycle is completed. For example, after the drying cycle is completed, the display 110 may output a message 1000 "Drying is completed. Clean the filter." The display 110 may output a graphic object such as an icon for informing that the filter 40 needs cleaning. Simultaneously, the sound device 130 may output a notification sound corresponding to the notification to clean the filter 40. In this way, the user may be guided to clean the filter 40 after the drying cycle is completed. As described above, a clothes dryer and a control method therefor disclosed herein can recall whether a filter has been cleaned and accurately inform a user of whether the filter needs cleaning.

A clothes dryer and a control method therefor disclosed herein can guide correct management of a filter by providing a notification in a case in which the filter needs cleaning. Therefore, it is possible to prevent a problem that may occur due to not cleaning the filter.

Meanwhile, embodiments disclosed herein may be implemented in the form of storage media storing computer-executable instructions. The instructions may be stored in the form of program codes and may, when executed by a processor, generate program modules and perform operations of the embodiments disclosed herein.

Device-readable storage media may be provided in the form of non-transitory storage media. Here, "non-transitory storage media" only indicates that they are tangible devices and do not contain signals (e.g., electromagnetic waves), and this term does not distinguish between a case in which data is semi-permanently stored in storage media and a case in which data is temporarily stored. For example, "non-transitory storage media" may include a buffer in which data is temporarily stored.

Methods according to various embodiments disclosed in this document may be provided by being included in computer program products. The computer program products may be traded between sellers and buyers as commodities. The computer program products may be distributed in the form of device-readable storage media (e.g., a compact disc read-only memory (CD-ROM)) or may be, through an application store (e.g., Play Store™) or between two different user devices (e.g., smartphones), directly distributed (e.g., downloaded or uploaded) online. In the case of online distribution, at least a part of the computer program products (e.g., downloadable apps) may be at least temporarily stored in device-readable storage media such as a server of a manufacturer, a server of an application store, or a memory of a relay server or may be temporarily generated.

Embodiments disclosed herein have been described above with reference to the accompanying drawings. Those of ordinary skill in the art to which the present disclosure pertains should understand that the present disclosure may be carried out in forms different from the embodiments disclosed herein, without changing the technical spirit or essential features of the present disclosure. The embodiments disclosed herein are illustrative and should not be construed as limiting.

What is claimed is:

1. A clothes dryer comprising:

a cabinet;

a control panel including a power button and a display;

a drum rotatable inside the cabinet;

a filter configured to filter air discharged from the drum;

a filter sensor configured to detect a mounting state of the filter and output a detection signal based on the mounting state of the filter detected;

a memory configured to record a change in the mounting state of the filter as an event based on the mounting state of the filter detected by the filter sensor; and a processor configured to communicatively connect to the control panel, the filter sensor, and the memory and control the display so that the display displays a notification relating to management of the filter based on whether the event due to the change in the mounting state of the filter is recorded in the memory.

2. The clothes dryer of claim 1, wherein, in response to a control signal that is received in association with input via the power button of the control panel, the processor is configured to read whether the event is recorded in the memory.

3. The clothes dryer of claim 2, wherein, based on absence of the event in the memory, the processor is configured to control the display to display the notification, and based on presence of the event in the memory, the processor is configured to control the display not to display the notification.

4. The clothes dryer of claim 3, wherein the filter sensor outputs the detection signal based on sensing magnetic force from a magnet disposed on the filter while the filter is coupled to the clothes dryer.

5. The clothes dryer of claim 2, wherein the processor is configured to control the display to output a message requesting selection of a drying course based on the event being recorded in the memory and to perform a drying cycle based on a signal indicating the selection of the drying course that is received through the control panel.

6. The clothes dryer of claim 3, wherein the processor configured to:

control the display to output a message requesting selection of a drying course based on a confirmation signal received through the control panel or a signal indicating remounting of the filter that is received from the filter sensor after the processor controls the display to display the notification, and perform a drying cycle based on a signal indicating selection of the drying course is received through the control panel.

7. The clothes dryer of claim 5, wherein the processor is configured to reset the memory in response to the signal indicating the selection of the drying course or to reset the memory in response to completion of the drying cycle.

8. The clothes dryer of claim 4, wherein the processor is configured to record the event in the memory based on the detection signal that is output from the filter sensor being stopped and resumed subsequent to being stopped.

9. The clothes dryer of claim 8, wherein the processor is configured to record the event in the memory using standby power in a state in which power of the clothes dryer is turned off.

10. A control method of a clothes dryer, comprising:

receiving a detection signal from a filter sensor configured to detect a mounting state of a filter configured to filter air discharged from a drum;

based on the detection signal, recording a change in the mounting state of the filter as an event in a memory; and based on the event recorded in the memory, controlling a display so that the display displays a notification relating to management of the filter based on whether the event due to the change in the mounting state of the filter is recorded in the memory.

11. The control method of claim 10, wherein whether the event is recorded in the memory is read in response to a control signal received in association with input via a power button.

12. The control method of claim 11, wherein, based on absence of the event in the memory, the display is controlled to display the notification, and based on presence of the event in the memory, the display is controlled to not to display the notification.

13. The control method of claim 10, wherein the event recorded in the memory includes an event recorded in a state in which power of the clothes dryer is turned off.

14. The control method of claim 10, wherein the event recorded in the memory is based on the filter being removed and subsequently being mounted.

15. The control method of claim 10, wherein the memory is reset in response to a signal indicating selection of a drying course that is received through a control panel.

* * * * *